US005127106A

United States Patent [19]

Aldridge

[11] Patent Number: 5,127,106

[45] Date of Patent: Jul. 7, 1992

[54] FIREFIGHTER JACKET

[75] Inventor: Donald Aldridge, New Carlisle, Ohio

[73] Assignee: Lion Apparel, Inc., Dayton, Ohio

[21] Appl. No.: 661,408

[22] Filed: Feb. 26, 1991

[51] Int. Cl.[5] ..... A41D 13/00

[52] U.S. Cl. ..... 2/81; 2/79; 2/93; 2/96; 2/97

[58] Field of Search ..... 2/69, 70, 81, 82, 85, 2/86, 87, 93, 94, 96, 97, 108

[56] References Cited

U.S. PATENT DOCUMENTS

| | | | |
|---|---|---|---|
| 1,005,569 | 10/1911 | De Meir | 2/81 |
| 2,305,499 | 12/1942 | Shane | 2/97 |
| 3,665,517 | 5/1972 | Hyman | 2/84 |
| 4,034,417 | 7/1977 | Ellis | 2/82 |
| 4,502,153 | 3/1985 | Lapedes | 2/81 |
| 4,549,315 | 10/1985 | English | 2/79 |
| 4,638,509 | 1/1987 | Charron | 2/21 |
| 4,768,233 | 9/1988 | Grilliot | 2/97 |
| 4,774,725 | 10/1988 | Page | 2/93 |
| 4,817,210 | 4/1989 | Aldridge | 2/81 |
| 4,843,646 | 7/1989 | Grillot et al. | 2/69 |
| 4,862,517 | 9/1989 | Meistrell | 2/21 |
| 4,999,850 | 3/1991 | Grilliot | 2/93 |
| 5,007,112 | 4/1991 | Lewis | 2/79 |

FOREIGN PATENT DOCUMENTS

| | | | |
|---|---|---|---|
| 484135 | 5/1938 | United Kingdom | 2/96 |

*Primary Examiner*—Werner H. Schroeder
*Assistant Examiner*—Diana L. Biefeld
*Attorney, Agent, or Firm*—Thompson, Hine and Flory

[57] ABSTRACT

A firefighter jacket of the type having an outer shell and an inner, removable liner includes a closure assembly having multiple layers of material in excess of the number required to provide sufficient thermal and moisture protection is improved in that the closure assembly is displaced from the central portion of the jacket to one side sufficiently to clear the high perspiration area of the central chest, whereby the high perspiration area is covered only by the minimum acceptable layers of material so that heat loss and perspiration evaporation through this area is not impeded excessively.

19 Claims, 2 Drawing Sheets

FIREFIGHTER JACKET

BACKGROUND OF THE INVENTION

This invention relates to firefighter jackets and, more particularly, to firefighter jackets having multi-layered closure assemblies.

The National Fire Protection Association (NFPA) requires that firefighter jackets must meet certain specific standards. As a minimum requirement, the garment must consist of an outer shell which is flame resistant and preferably resists punctures and abrasion, an intermediate moisture barrier layer, and an inner thermal layer for protecting the wearer against extreme temperatures. Typically, firefighter jackets are made to have a front opening extending vertically from the neck opening to the bottom edge of the jacket. The opening is centered so that there is an approximately equal chest area on each side of the opening when the jacket is closed.

NFPA standards require that this opening be secured by a closure mechanism comprising a mechanical interlock, such as a slide fastener. The configuration of the closure area of such jackets necessarily includes at least a flap covering the closure mechanism compressing a double layer of outer shell material. However, typically, up to four or more layers of outer shell material are present in the closure area as part of the closure assembly. In addition to multiple layers of outer shell material, the closure mechanism also contains one or more additional layers of moisture barrier and thermal liner material and two or more layers of fastener material such as the commonly-employed hook and loop fasteners, as well as the material associated with the mechanical closure component. Consequently, a total of as many as seven thicknesses of material—in addition to the minimum required by NFPA standards—is located in the closure area.

It is known that the human body has several distinct areas of high perspiration which are important in maintaining an acceptable body core temperature. One such high perspiration area is located in the medial chest region as substantially defined by the sternum. This high perspiration area coincides with the closure assembly of the typical firefighter jacket. Consequently, normal cooling resulting from perspiration in this area is impeded by the additional layers of material comprising the closure assembly.

In the past, most of the advancements in firefighter garments have been directed to improvements in the materials used to construct the various layers forming the garment. Other developments have been aimed at improving the flexibility of the garments. For example, U.S. Pat. No. 4,843,646 relates to a firefighter's protective clothing system which provides improved flexibility while retaining maximum insulating protection.

Accordingly, there is a need to provide a firefighter jacket which not only provides sufficient protection to the firefighter but is also capable of reducing stress caused by excess layers of material in the critical high perspiration area of the central chest of the wearer's body.

SUMMARY OF THE INVENTION

The present invention is an improved firefighter jacket which promotes cooling of the wearer by minimizing the amount of material covering the high perspiration area of the central chest. The jacket includes an outer shell having a body section with a neck opening and a vertically-extending front opening, an inner liner shaped to fit within the outer shell and which is coextensive therewith, and a closure assembly for releasably closing the front openings of the outer shell and inner liner, the closure assembly including at least a closure mechanism and a cover flap.

The closure assembly is displaced sidewardly from its normal central chest position sufficiently to clear the high perspiration area of the central chest. The high perspiration area is covered only by a single layer of shell material and inner lining, and therefore the rate of dissipation of heat from this region is maximized.

Accordingly, it is an object of the present invention to provide a firefighter jacket wherein the closure assembly is displaced sidewardly from a central position sufficiently to not overlie the high perspiration area of the central chest; to provide an NFPA approved firefighter jacket wherein only a single layer of outer shell material covers the high perspiration area located in the high perspiration central chest region of the wearer; and a firefighter jacket which is rugged in construction and can be put on and taken off easily.

Other objects and advantages of the invention will be apparent from the following description, the accompanying drawings and the appended claims.

DETAILED DESCRIPTION

Figure 1:
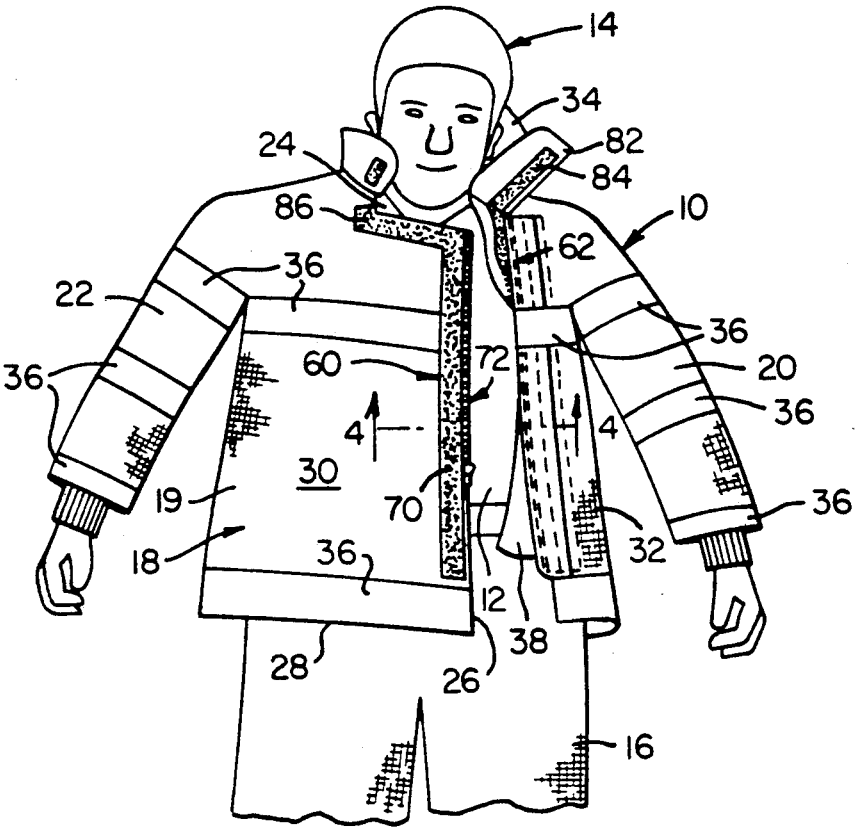
FIG. 1 is a front elevational view of a firefighter jacket of the present invention in an open configuration on a user, illustrating the front opening and closure assembly.

As shown in FIG. 1, the firefighter jacket of the present invention, generally designated 10, is shaped to cover the upper torso 12 of a wearer 14. The jacket 10 is worn in conjunction with similarly-constructed firefighter pants 16.

The jacket 10 includes an outer shell 18 made of a woven aramid fiber such as NOMEX III or KEVLAR ("NOMEX III" and "KEVLAR" are registered trademarks of E.I. DuPont de Nemours & Co., Inc.). The shell 18 includes a body section 19 having left and right sleeves 20, 22, respectively, a neck opening 24 and a front opening 26 extending from the neck opening 24 to the bottom hem 28 of the jacket 10. The front opening 26 divides the jacket 10 into left and right chest panels 30, 32. The shell 18 includes a collar 34 which is attached to and extends about the periphery of the neck opening 24. Strips of reflective material 36 are attached to the outer shell 18 in the form of horizontal stripes.

Figure 3:
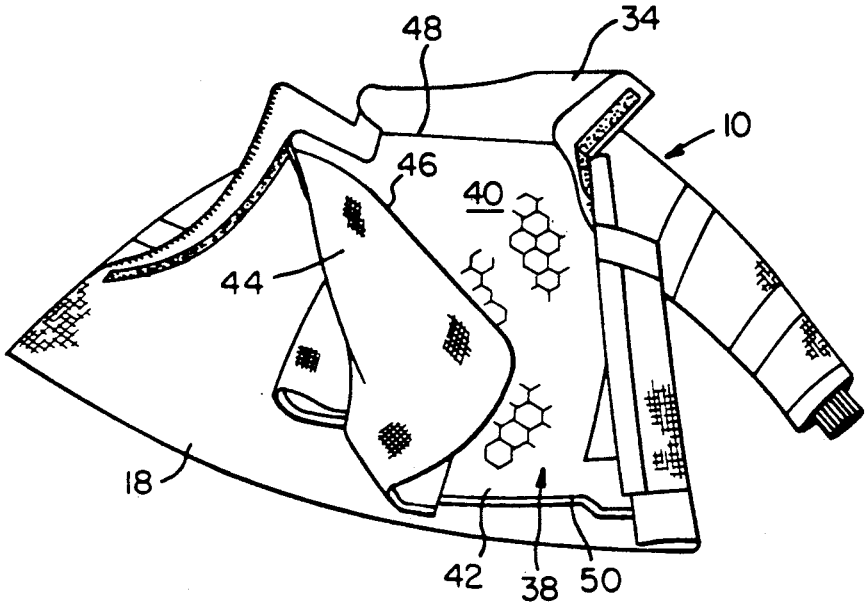
FIG. 3 is a front elevational view of the firefighter jacket of FIG. 1, opened to show the inner layer.

As shown in FIGS. 1 and 3, the jacket 10 includes an inner liner, generally designated 38. The inner liner 38 is substantially coextensive with the outer shell and includes a body section 40 having sleeves (not shown). The inner liner comprises a thermal barrier 42 and a moisture barrier 44. The moisture barrier 44 preferably comprises a composite of NOMEX and KEVLAR laminated with GORE-TEX ("GORE-TEX" is a registered trademark of W. L. Gore & Associates, Inc.). The thermal layer 42 preferably comprises a NOMEX face cloth quilted to two layers of a 70% NOMEX-30% KEVLAR composite. Alternately, the thermal layer 42 may comprise a NOMEX face cloth quilted to 100% NOMEX batting. Other types of moisture barriers and thermal layers commonly employed in the art are usable here. The moisture barrier 44 is attached to the thermal barrier 42 and is positioned intermediate the thermal layer and outer shell 18. The inner liner 38 includes a front opening 46 which extends from a neck opening 48 to the bottom hem 50 of the inner liner 38. The combination of the single layer of NOMEX in the shell 18 with the moisture and thermal protection of the inner liner 38 is sufficient to meet NFPA standards for heat and flame resistance.

Figure 4:
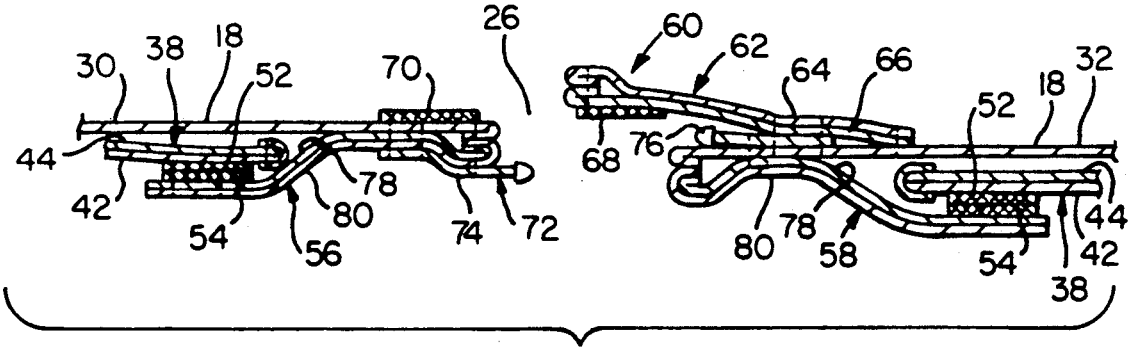
FIG. 4 is a cross section of the closure assembly taken at line 4—4 of FIG. 1.

As shown in FIG. 4, the inner liner 38 includes strips of one component 52 of hook and loop material which engages strips of the mating component 54 attached to inner flaps 56, 58. Flaps 56, 58 are attached to the inner surface of the outer shell 18 and extend along the edges of the left and right chest panels 30, 32 forming the front opening 26. The inner flaps 56, 58 form pockets with the body section 19 which receive edges of the inner liner 38.

As shown in FIGS. 1 and 4, the front opening is secured by a closure assembly, generally designated 60. The closure assembly 60 includes an outer flap 62 comprising inner and outer layers 64, 66 of shell material sewn together. Layer 66 includes a strip of one component 68 of hook and loop material which engages a strip of the mating component 70 attached to the outer surface of outer shell 18 of left chest panel 30 along the edge of the front opening 26. A closure member 72 comprises a slide fastener and includes mating components 74, 76. Component 74 is in strip form and is attached to inner flap 56, while component 76 is sandwiched between outer flap 62 and outer shell 18 of right chest panel 32.

Inner flaps 56, 58 each include an inner moisture barrier layer 78 stitched to an outer layer of shell material 80. Consequently, the closure assembly 60 provides two additional layers of material in the outer flap 62, two additional strips of material in hook and loop closures 68, 70, two additional layers of material in inner flaps 56, 58, two additional strips of material in hook and loop closures 52, 54 and an additional strip of material in the slide fastener of closure member 72. Accordingly, closure assembly 60 includes, in total, at least seven layers of material in addition to that required by NFPA standards.

As shown in FIG. 1, the closure assembly 60 includes a chin flap 82 which extends across the outer shell and is attached by mating strips 84, 86 of hook and loop material. Strap 82 is comprised of two layers of shell material enclosing a section of inner liner (not shown).

Figure 2:
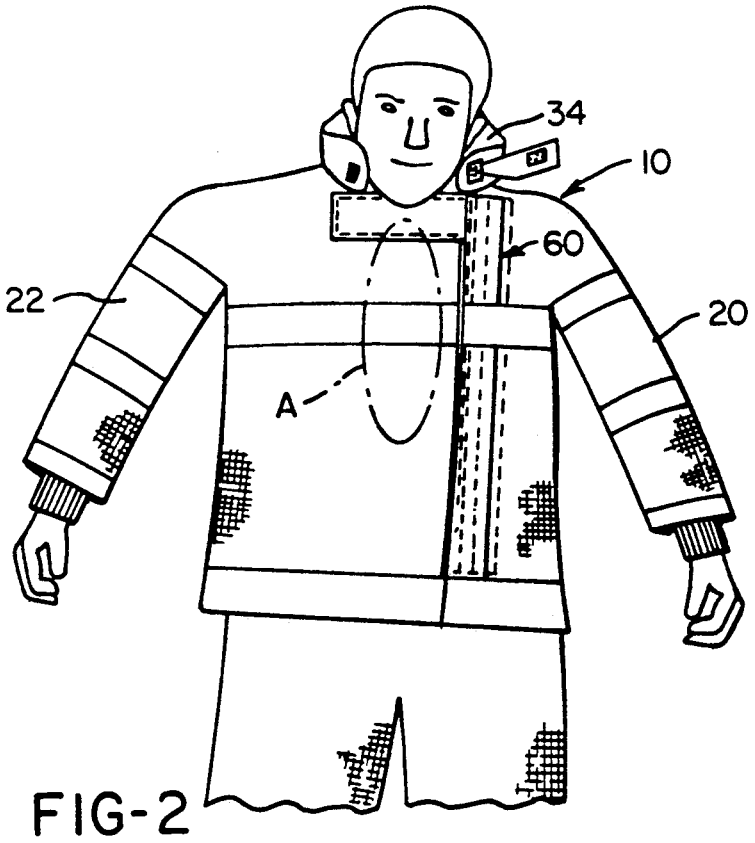
FIG. 2 is a front elevational view of the firefighter jacket of FIG. 1 in a closed configuration, showing the high perspiration area of the central chest in broken lines.

As shown in FIG. 2, the left and right chest panels 30, 32 are sized such that the closure assembly 60 is offset from the high perspiration area of the central chest, denoted by the ellipse A. The closure assembly 60 is secured by connecting the components 74, 76 of the slide fastener 72, then pressing the outer flap 62 so that hook and loop fastener components 68, 70 engage to provide a water resistant covering for the closure member 72. When closed, the multiple layers of material of the closure assembly 60, shown in FIG. 4, do not overlie A and therefore do not interfere with the escape of perspiration and concommitant release of body heat through the central chest area A. Indeed, the material covering the area A is the minimum required by NFPA standards. Consequently, it easier for a user 14 to dissipate heat and perspiration through area A in firefighting activities with the jacket 10, and thereby maintain an acceptable body core temperature.

While the form of apparatus herein described constitutes a preferred embodiment of the invention, it is to be understood that the invention is not limited to this precise form of apparatus, and that changes may be made therein without departing from the scope of the invention.

What is claimed is:

1. A firefighter jacket comprising:

an outer shell having a body section, left and right sleeves, a neck opening and a substantially vertically-extending front opening dividing said body section into left and right chest portions;

an inner liner shaped to fit within said outer shell, said liner having a body section, a neck opening coinciding with said outer shell neck opening and a substantially vertically-extending front opening dividing said liner body section into left and right chest portions; and means for closing said outer shell and liner body sections at said front openings, said closing means including means for releasably joining together said left and right chest portions of said shell and liner and an outer flap extending along said outer shell body section and positioned to overlie said joining means and segments of said outer shell chest portions contiguous to said joining means when said jacket is closed, said outer flap and said contiguous segments forming at least a double thickness of material at said front opening, said front opening and said closure means being displaced from a center of said body section towards one of said sleeves sufficiently to offset said cover flap and said segments from a high perspiration area of a central chest of a wearer such that only a single layer of said outer shell and said inner liner covers said high perspiration area when said jacket is worn closed.

2. The firefighter jacket of claim 1 wherein said closing means includes a slide fastener for releasably joining said chest portions.

3. The firefighter jacket of claim 2 wherein said cover flap is permanently attached to one of said chest portions and is releasably attached to the other of said chest portions.

4. The firefighter jacket of claim 3 wherein said cover flap is releasably attached to said other of said chest portions by hook and loop fasteners.

5. The firefighter jacket of claim 1 wherein each of said outer shell chest portion includes an inner flap permanently attached to said outer shell chest portions and extending along said front opening and shaped to form an elongated pocket for receiving a corresponding peripheral edge of said inner liner along said front opening such that said outer shell chest portion, said outer flap, and said inner flap form at least three thicknesses of material, said three thicknesses of material being displaced from said high perspiration area.

6. The firefighter jacket of claim 5 wherein said elongated pocket includes means for releasably attaching said inner liner to said outer shell.

7. The firefighter jacket of claim 6 wherein said inner liner is releasably attached to said outer shell by hook and loop fasteners.

8. The firefighter jacket of claim 5 wherein said outer shell is made of a woven aramid fiber.

9. The firefighter jacket of claim 5 wherein said outer flap is made from a woven aramid fiber.

10. The firefighter jacket of claim 5 wherein inner flap is made from a woven aramid fiber.

11. The firefighter jacket of claim 5 wherein said inner liner is made from an aramid face cloth quilted to an aramid batting.

12. The firefighter jacket of claim 5 wherein said inner liner includes a moisture barrier layer facing said outer shell.

13. The firefighter jacket of claim 12 wherein said moisture barrier is an aramid material laminated with teflon.

14. The firefighter jacket of claim 5 wherein said inner flap includes a moisture barrier layer facing said inner layer.

15. The firefighter jacket of claim 14 wherein said moisture barrier is an aramid material laminated with teflon.

16. The firefighter jacket of claim 1 wherein said neck opening includes a collar member.

17. The firefighter jacket of claim 16 wherein said collar member is permanently attached to said outer shell about a periphery of said neck opening.

18. A firefighter jacket comprising:

an outer shell having a body section, left and right sleeves, a neck opening, a collar member extending outwardly from said neck opening, and a substantially vertically extending front opening dividing said body section into left and right chest portions;

an inner liner shaped to fit within said outer shell, said liner having a body section, a neck opening coinciding with said outer shell neck opening, left and right sleeves, and a substantially vertically extending front opening dividing said body section into left and right chest portions; and means for closing said body section of said outer shell along said front openings, said closing means including means for releasably joining said outer shell chest portions together including a slide fastener and an outer flap, said outer flap extending along said outer shell body section and positioned to overlie said joining means, said cover flap being permanently attached to one of said outer shell chest portions and releasably attached to the other of said outer shell chest portions by hook and loop fasteners, said jacket when closed having multiple thicknesses of material at said front opening, said front opening and said closure means being displaced from the center of said body section to the left or right towards one of said sleeves sufficiently to offset said multiple thicknesses of material from a high perspiration area of a central chest area of a wearer such that only a single layer of said outer shell covers aid high perspiration area when said jacket is worn closed.

19. A firefighter jacket comprising:

an outer shell having a body section of a single layer of material and a front opening;

an inner liner substantially coextensive with and shaped to fit within said outer shell, said inner liner having a moisture barrier layer, a thermal barrier layer and a vertically extending front opening corresponding to said outer shell front opening; and means for closing said outer shell front opening and said inner liner front opening, said closure means including a closure member for effecting a mechanical connection closing said front openings and including additional layers of material superposed to said closure member, said closure member being displaced toward a side of said jacket sufficiently to clear a high perspiration area of the central chest of a wearer of said jacket, such that said high perspiration area is covered only by said single layer of said outer shell and single layers of said moisture barrier layer and said thermal barrier layer.

* * * * *